US007100504B2

(12) United States Patent
Toledo

(10) Patent No.: US 7,100,504 B2
(45) Date of Patent: Sep. 5, 2006

(54) SHORT-CIRCUIT DETECTION PROBE

(75) Inventor: Dror Toledo, Modi'in (IL)

(73) Assignee: Creo Il. Ltd., Herzlia (IL)

( * ) Notice: Subject to any disclaimer, the term of this patent is extended or adjusted under 35 U.S.C. 154(b) by 118 days.

(21) Appl. No.: 10/791,533

(22) Filed: Mar. 3, 2004

(65) Prior Publication Data

US 2005/0193913 A1 Sep. 8, 2005

(51) Int. Cl.
*B41F 27/12* (2006.01)

(52) U.S. Cl. ..... 101/477; 101/484; 101/485; 101/481; 324/522; 324/525

(58) Field of Classification Search ..... 101/477, 101/216, 484, 485, 486, 481; 324/207.16, 324/207.13, 522, 525
See application file for complete search history.

(56) References Cited

U.S. PATENT DOCUMENTS 5,562,035 A * 10/1996 Pollich et al. ..... 101/232
6,469,500 B1 * 10/2002 Schmitz et al. ..... 324/207.16
6,604,465 B1 * 8/2003 Tice et al. ..... 101/415.1
6,865,987 B1 * 3/2005 Koyanagi et al. ..... 101/477
2003/0209680 A1 11/2003 Burkatovsky

* cited by examiner

*Primary Examiner*—Daniel J. Colilla
*Assistant Examiner*—Kevin D. Williams

(57) ABSTRACT

A short-circuit detection probe comprising a probe body having a housing and a cover, the housing defining an internal cavity having a profile, a probe pin comprising an upper part and a lower part, mounted within the internal cavity, the upper part comprising an electrically wired upper end and the lower part comprising a lower end connected to a magnet, a push springs wound around the upper part of the probe pin, a stoppage means mounted at the bottom of the push spring and a return spring wound around the lower part of the probe pin, wherein the internal cavity profile comprises a stoppage step for accommodating the stoppage means at its lowermost position.

15 Claims, 8 Drawing Sheets

SHORT-CIRCUIT DETECTION PROBE

FIELD OF THE INVENTION

The present invention is related to short-circuit detection probes and more specifically to probes designed to sense continuous short-circuit over a period of time.

BACKGROUND OF THE INVENTION

Short-circuit detection probes are used for a variety of applications involving position indication. For example, operations involving cutting, punching or drilling sheet material may require continuous inspection of the material's exact position. The material, preferably in sheet form, may be aligned for the operation with the help of any one or more sensing devices that create a short circuit when alignment is sensed. The short-circuit detection probe then detects the short circuit and may transmit the indication to a controller, according to the specific application. Any change in the proper alignment will be thus sensed and may similarly be reported for a possible correction operation.

Processes that are typically prone to movement of the material are those involving force. For example, a cutting or drilling operation may cause vibrations that will move the material, therefore requiring strong attachment of the material to a base prior to performing the operation. A problem may arise when the attachment, using a certain amount of force, causes a slight movement of the material.

The alignment sensor may be an electrical sensor, suitable for conductive metal substrates, or an optical sensor, such as described for example in Published U.S. patent application Ser. No. 2003/0209680 to the same assignee, having electrical connections.

In CTP devices, such as Lotem 800 available from Creo Inc., Canada, a printing plate blank is mounted on the surface of an external drum for imaging. In order for the plate to be correctly registered on the drum, it is known to use registration pins, mounted on the drum. When the plate is mounted on the drum, its front edge is moved towards the registration pins. When contact is established between the plate's front edge and at least two registration pins, a clamping mechanism is actuated to clamp the front edge of the plate to the drum. The plate is then further wound around the drum and its tail edge also clamped by a rear set of clamps.

Various mechanisms are known for detecting contact between the plate's front end and the registration pins. A special concern is to maintain the contact, once established, throughout the operation of clamping the plate's front-edge to the drum and report any shift to enable correction measures.

SUMMARY OF THE INVENTION

According to a first aspect of the present invention there is provided a short-circuit detection probe comprising: a probe body having a housing and a cover, the housing defining an internal cavity having a profile; a probe pin comprising an upper part and a lower part, the probe pin mounted within the internal cavity and comprising electrical connectivity and the lower part comprising a lower end connected to a magnet; a push springs wound around the upper part of the probe pin; stoppage means mounted at the bottom of the push spring; and a return spring wound around the lower part of the probe pin, wherein the internal cavity profile comprises a stoppage step for accommodating the stoppage means at its lowermost position.

According to one embodiment, the magnet comprises part of the lower end.

According to another embodiment, the stoppage means comprise a washer.

According to a second aspect of the present invention there is provided means for monitoring continued registration of a sheet of material in a device for processing the sheet, comprising: registration means for registering the sheet in a required position; sensing means for sensing the registration condition, the sensing means adapted to cause a short circuit upon sensing the condition; and a probe, magnetically connected with the sensing means, for maintaining electric continuity, thereby continuously monitoring the registration condition during a predefined sequence of operations.

According to one embodiment, the sensing means comprise an electrical sensor.

According to another embodiment, the sensing means comprise an optical sensor.

According to a third aspect of the present invention there is provided a method of monitoring continuous registration of a mounted printing plate until the plate's leading edge is firmly secured to the surface of the drum, in an external drum CTP device, comprising the steps of: providing a plurality of leading edge clamps along the longitudinal axis of the drum surface; providing a detachable clamp actuator for opening the clamps for accommodating and releasing a printing plate; attaching a plurality of short circuit detection probes to the actuator, each the probes positioned with respect to a respective one of the leading edge clamps; providing registration pins on the surface of the drum, each the registration pins electrically connected with a respective probe area; operating the actuator to open the plurality of leading edge clamps, whereby the probes create electric continuity by contacting the respective probe areas and are magnetically attached thereto; mounting a printing plate onto the external surface of the drum until the leading edge of the plate contacts the registration pins thereby creating a short circuit; and detaching the actuator from the leading edge clamps, thereby closing the clamps for securing the registered plate, wherein the probe remains magnetically attached to the probe area thus providing continued electric continuity for a period of time following the detaching.

According to one embodiment the period of time is determined by the maximum distance between the stoppage means and the stoppage step.

BRIEF DESCRIPTION OF THE DRAWINGS

For a better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF THE INVENTION

Figure 1A:
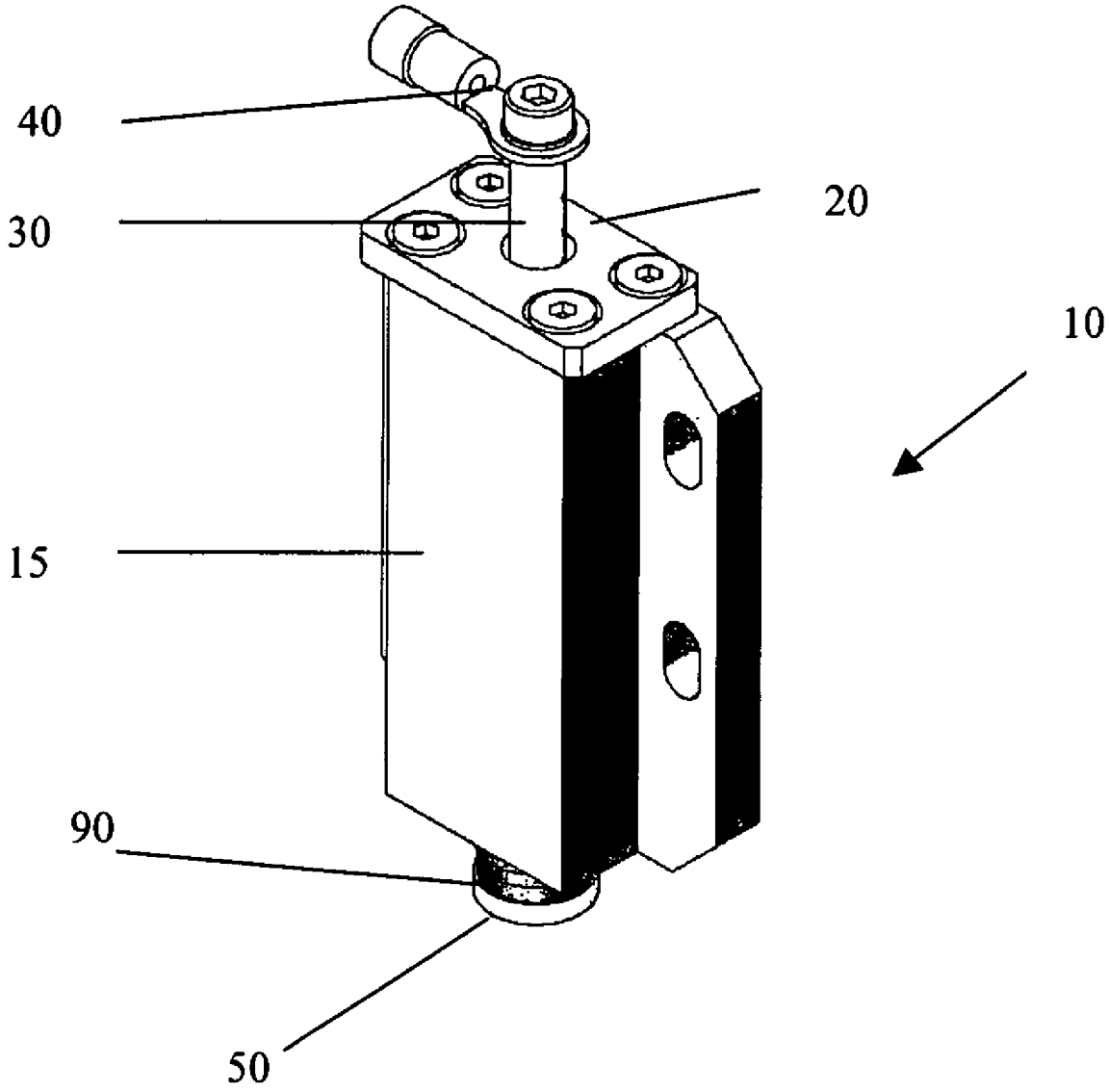
FIGS. 1A through 1C are schematic drawings of the short-circuit detector probe outside and inside views, respectively, according to the present invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

The present invention provides an improved short-circuit detection probe. The new probe may be advantageously applied to all types of detection application involving moving parts, or static detection applications such as PCB test beds.

In the example of plate-loading in a computer-to-plate (CTP) system, the short-circuit detector probe of the present invention is designed to advantageously detect a short-circuit created by the plate's front-edge touching a plurality of registration pins on the drum, and to monitor the continued existence of the short-circuit until the plate's front-edge is securely clamped to the drum. This goal is achieved by using a magnet to maintain electric continuity. The magnetic force acts as a releasable clamp and provides a rigid mount that may withhold vibrations or movements. Another advantage of the probe of the present invention, in conjunction with plate clamps, lies in the fact that its magnetic hold and the electric circuit continuity are still active while the clamp is being released from its actuator.

Figure 1B:
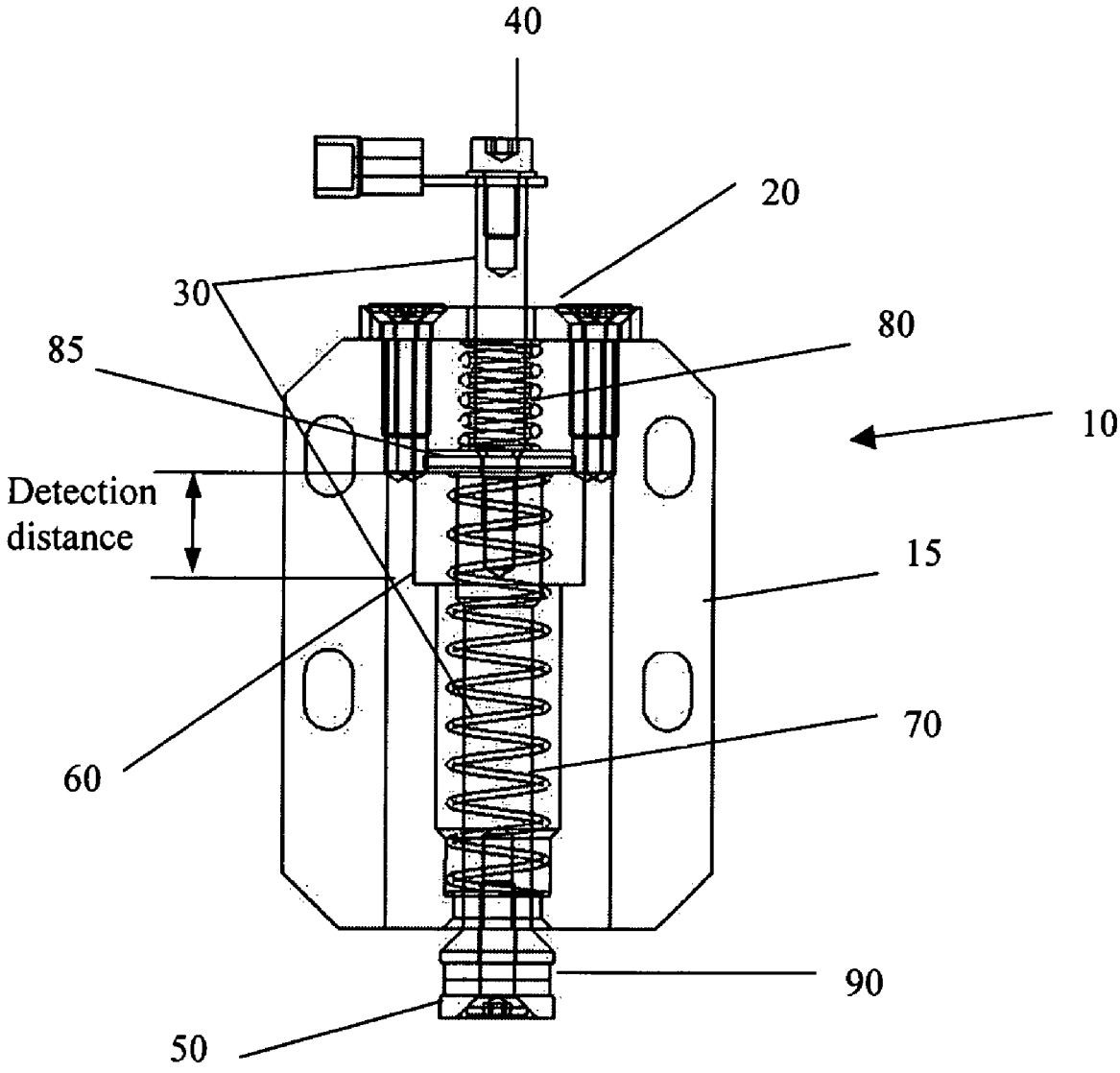
Figure 1C:
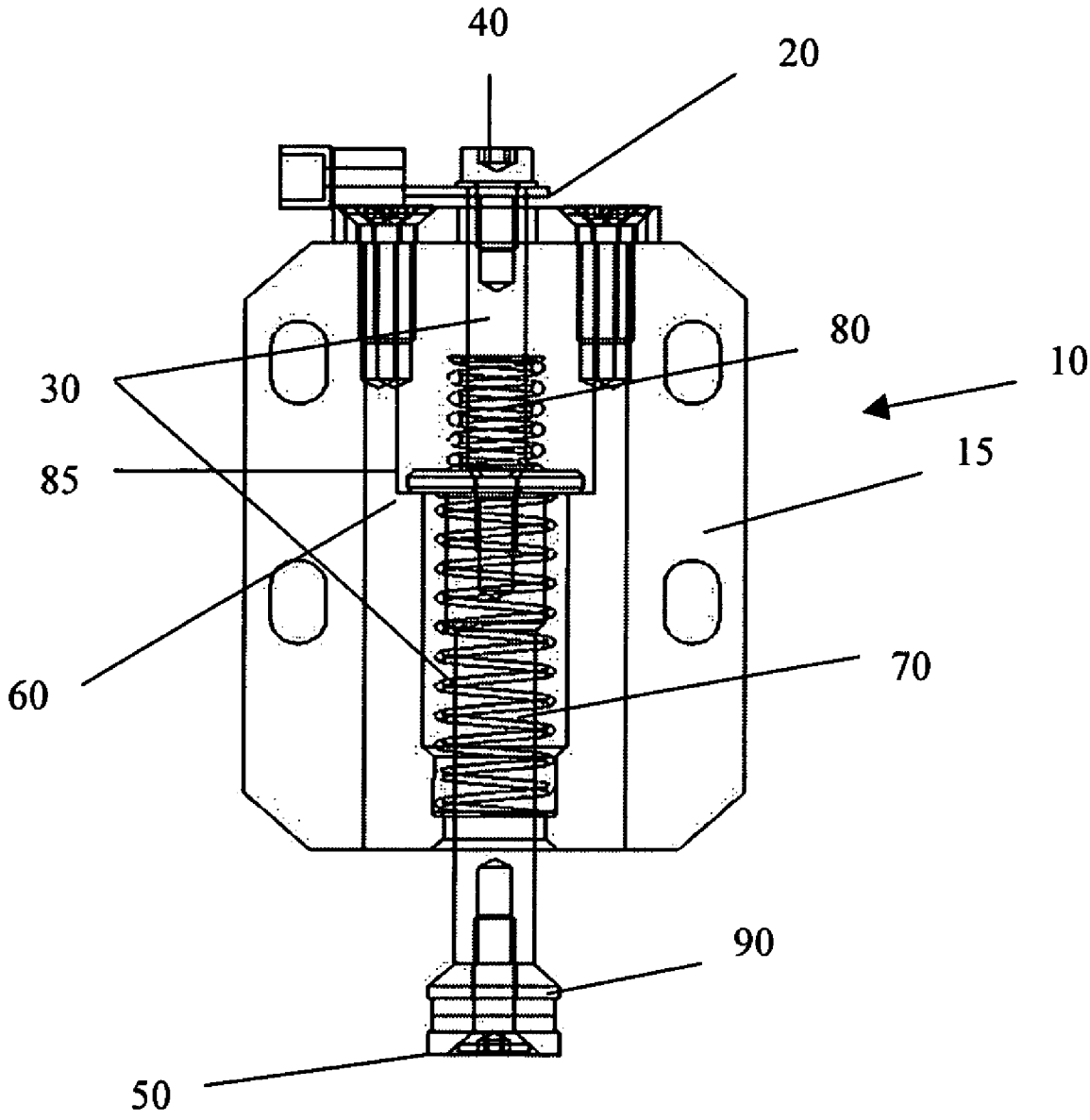

FIGS. 1A through 1C are schematic drawings of the short-circuit detector probe outside and inside views, respectively, according to the present invention.

The probe of the present invention, generally denoted by numeral 10, comprises a probe body 15 and a probe body cover 20. The body 15 and cover 20 may be made from any plastic material, such as Derelin, or from aluminum with hard anodized coating, or any other suitable isolating material known in the art, to electrically and magnetically isolate the inner parts. A probe pin 30 is mounted along the inner part of the detector body 15 and emerges from a hole in the cover 20. The probe pin 30 connects between magnets 90, mounted on the lower side of probe 10 and wire connection 40 and serves to conduct current from the probed area to the wire 40. Probe pin 30 should be made from a non-magnetic material and should be electrically conductive. Materials such as aluminum, Stainless Steel 303 or brass are suitable. A push spring 80 is twisted around the upper part of probe pin 30 inside the probe body 15. Push spring 80 may be made from any spring steel, e.g. music wire steel. A return spring 70 is twisted around the lower part of probe pin 30 inside the probe body 15. Spring 70 should be made of a non-magnetic material, e.g. Stainless Steel 302. A stoppage step 60 in the inner profile of the body 15 is situated at a "detection distance" from a stoppage means 85 (constituting a "limiter device"), at the bottom end of push spring 80. This "detection distance" determines the travel length which the probe can draw away from the probed area and still detect short circuit. In other words the "detection distance" is the distance that the body of the probe can draw away from the probed area while still ensuring that the pin makes electrical contact with the electrically conductive element. The stoppage means 85 may comprise a washer, or any other means known in the art. The return spring 70 makes sure the probe pin 30 is in its upper position when not active. i.e. when it is not yet primed and ready to detect. The probe pin 30 is designed to float inside the probe body 15 so as not to be affected by small vibrations, motion or misalignment. The push spring 80 acts as a shock absorber when the magnet pops off the probed area, and pushes the magnet toward the probed area to assure attachment when the probe is active i.e. when it is primed and ready to detect. A metal washer 50 is attached to the magnets 90 at the lower end, so the magnet does not have direct contact with the probed area, for two reasons: first, magnet is a very brittle material and the direct contact might break it; second, the metal conducts better than magnet. The magnets 90 may be chosen according to application-dependent required force. In the exemplary CTP application described herein two Neodymium magnets were placed front-to-back. Other magnets such as Alnico or Ceramic may be used. The metal washer 50 should be made from a very good magnetic and electric conductor, such as a low-carbon steel (SAE 1008–1016) with electroless Nickel coating. This gives a very strong, wear-resistant coating with good conductivity.

In an alternative embodiment the magnet 90 may be attached to the contact probe area.

Figure 2:
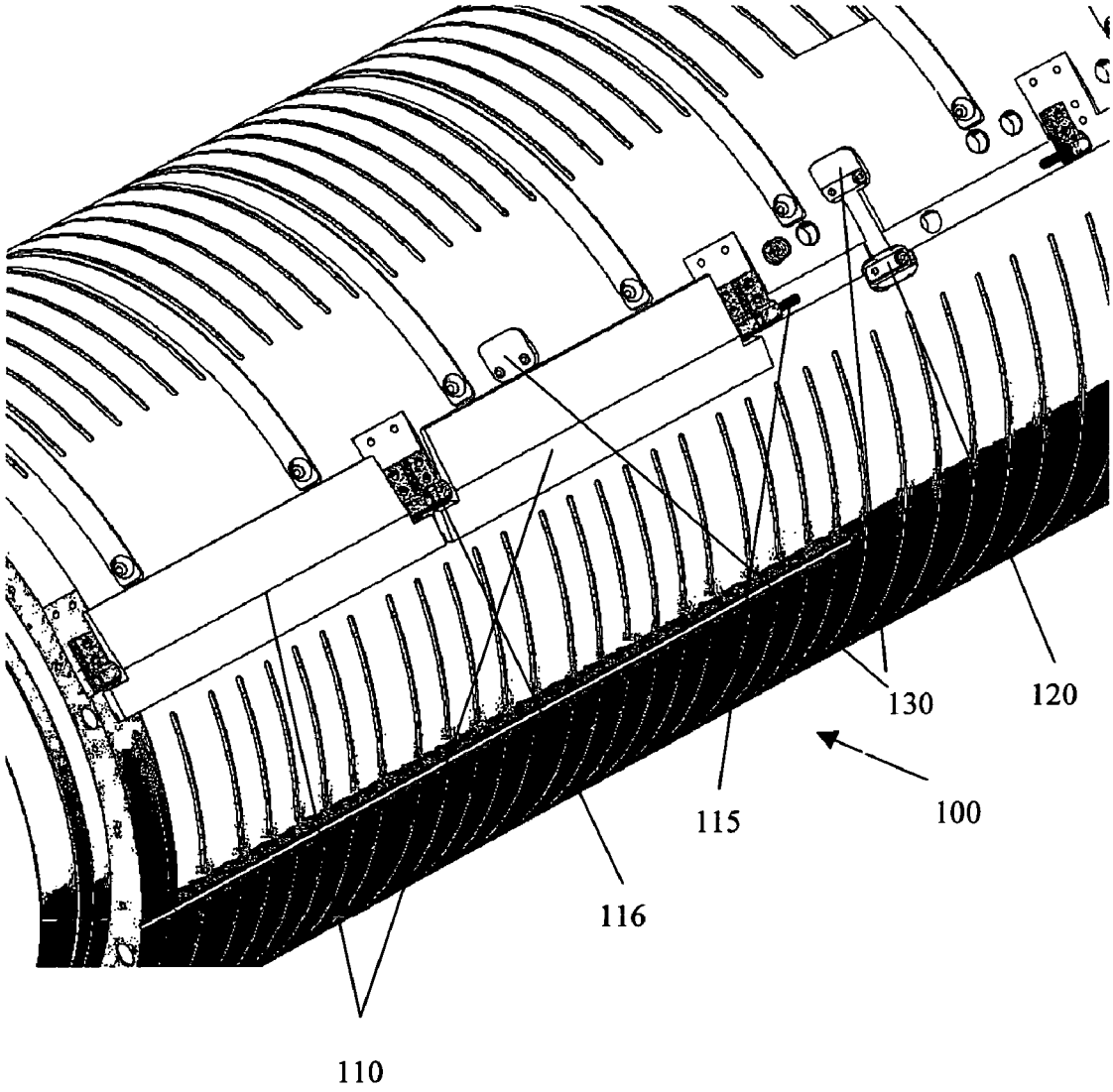
FIG. 2 is a schematic drawing of an external drum for mounting plates in a CTP device.

The operation of the short-circuit detector probe of the present invention will now be described in conjunction with the non-limiting example of a CTP device. FIG. 2 is a schematic drawing of an external drum for mounting plates in a CTP device. Leading Edge Clamps (LEC) 110 are sequentially mounted external to the drum 100 Darallel to the longitudinal axis of the drum 100. Each LEC 110 has two pins shafts 115 mounted firmly at the sides of the clamp. The shaft is rotated in a plastic bearing 116, which is mounted at the clamp housing. Plate registration pins 120 are mounted on the drum, along the same axis. Each registration pin 120 is connected to a registration pin contact probe area 130, mounted at the rear end of the adjacent LEC 110.

Figure 3:
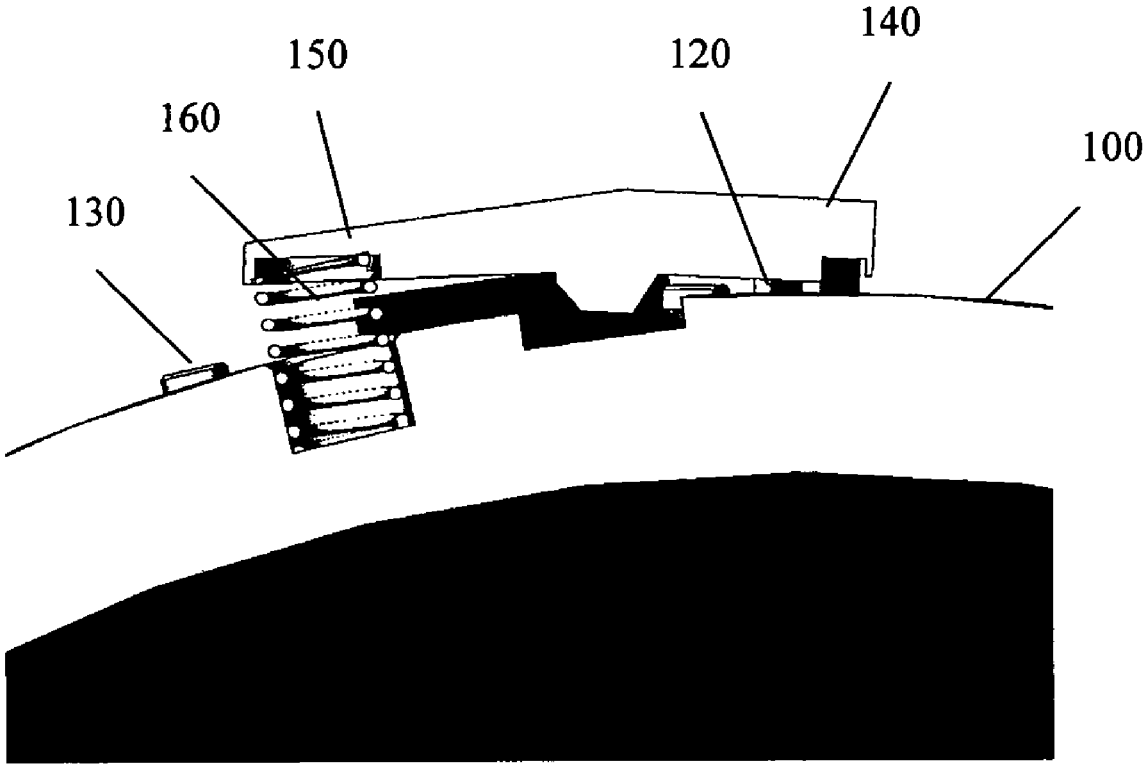
FIG. 3 is a schematic section view of an exemplary LEC for clamping the leading edge of a printing plate to an external drum.

FIG. 3 is a schematic section view of an exemplary LEC for clamping the leading edge of a printing plate to an external drum 100. The LEC comprises a front side 140, which may be opened to accommodate a leading edge of a plate and a rear-end 150, including a spring 160. FIG. 3 additionally shows a registration pin 120 and its associated contact probe area 130.

Figure 4A:
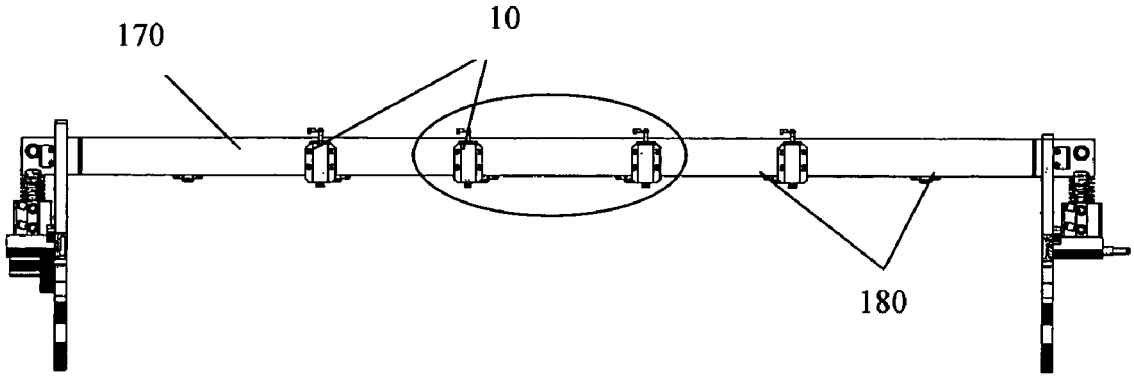
FIGS. 4A and 4B are front views of the LEC's actuator.
Figure 4B:
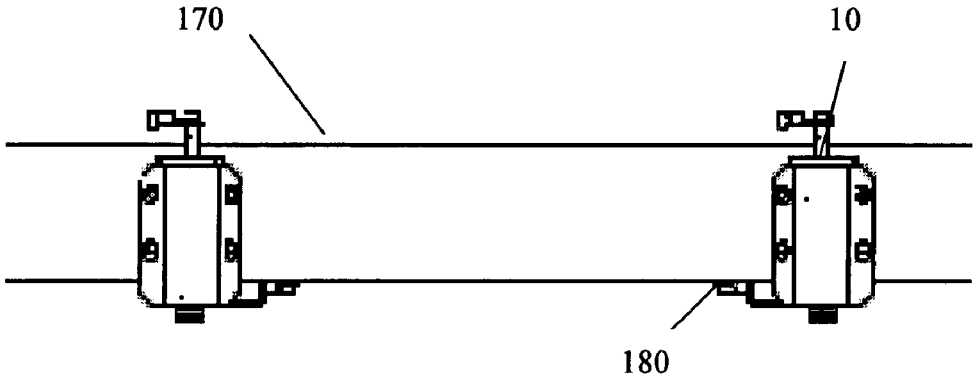

FIG. 4A is a front view of the LEC's actuator 170, along which a plurality of probes 10 are mounted. The actuator 170 is mounted external to the drum 100 parallel to the longitudinal axis of the drum 100 and is attached to the machine side-plates, located on both sides of the drum. FIG. 4B is a blown-up view of the circled area in FIG. 4A. The clamp actuator 170 pushes the clamp's rear-end 150 when opening it, by rolling bearings 180, to reduce friction force and wear on the clamp.

Between and during imaging sessions, the actuator 170 is at a distance from the drum, so as not to be in the way of other components mounted to the drum. When a new plate is mounted, the actuator 170 is lowered towards the drum and its bearings 180 push the rear-end 150 of the LECs, applying force on springs 160 and thereby opening the front-end 140 of the LEC to accommodate the plate. Once the plate has been securely clamped, the actuator is moved again, away from the drum.

Figure 5:
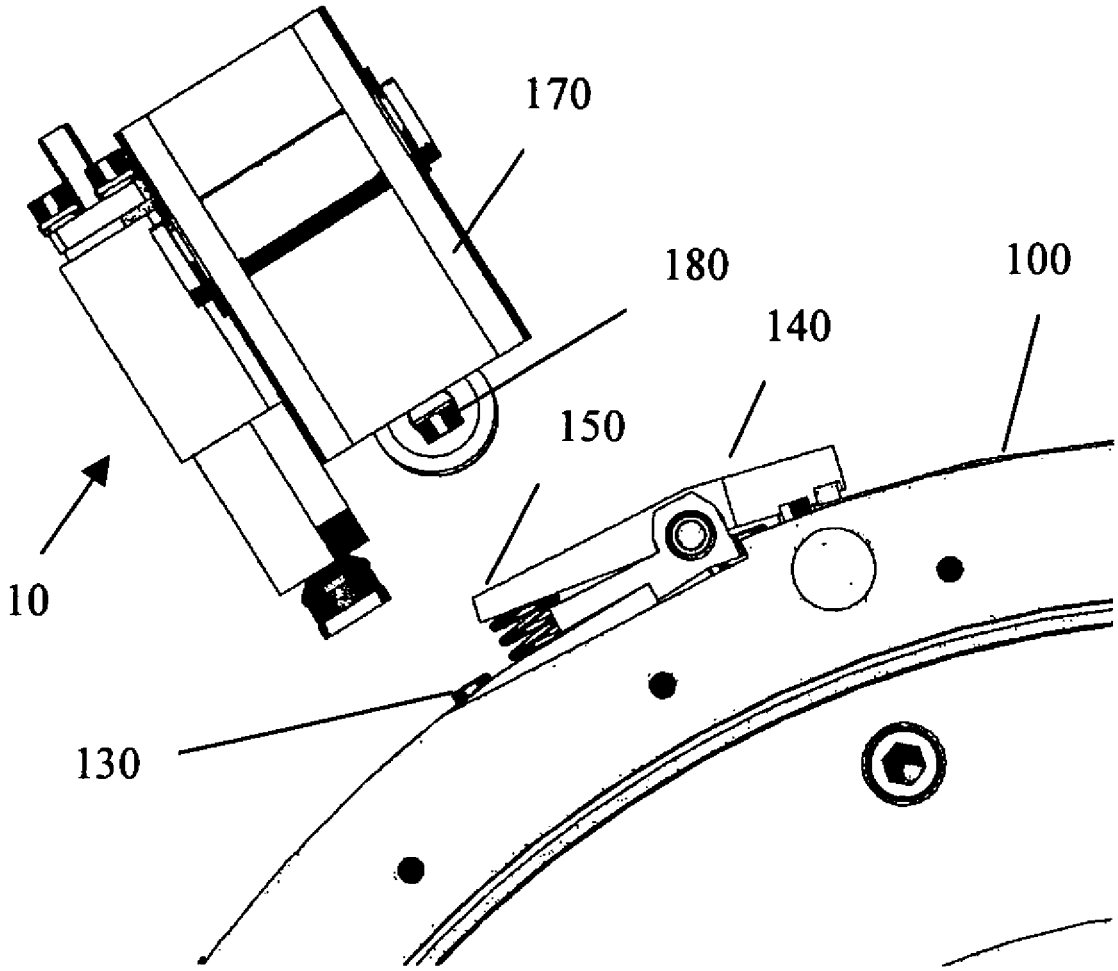
FIG. 5 is a schematic side view of the short-circuit detector probe of the present invention, mounted on the LEC actuator in its non-active position.

FIG. 5 is a schematic side view of the short-circuit detector probe 10 of the present invention, mounted on the LEC actuator 170 in its non-active position.

Figure 6A:
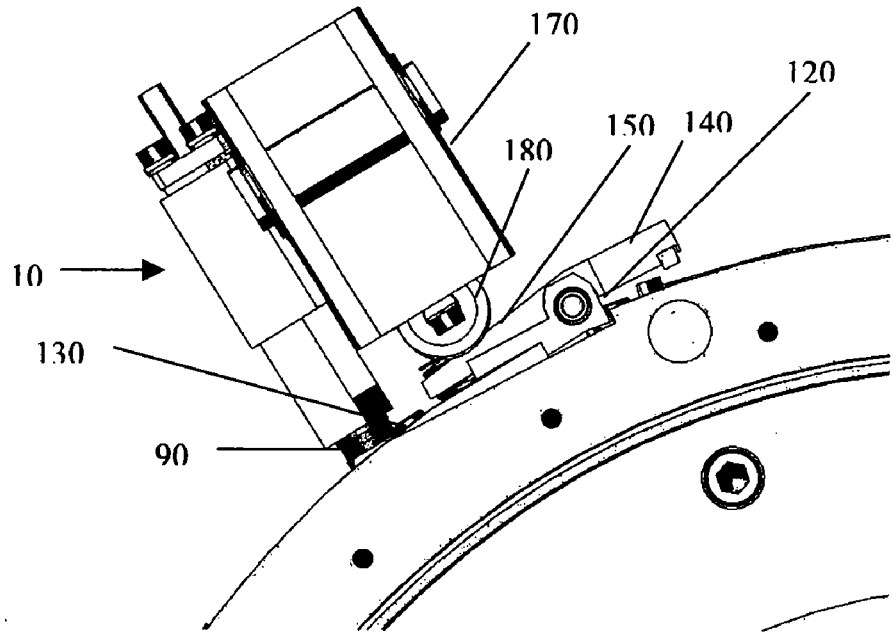
FIGS. 6A and 6B schematically show the operation of the short-circuit detector probe of the present invention, mounted on the LEC actuator, in operation.
Figure 6B:
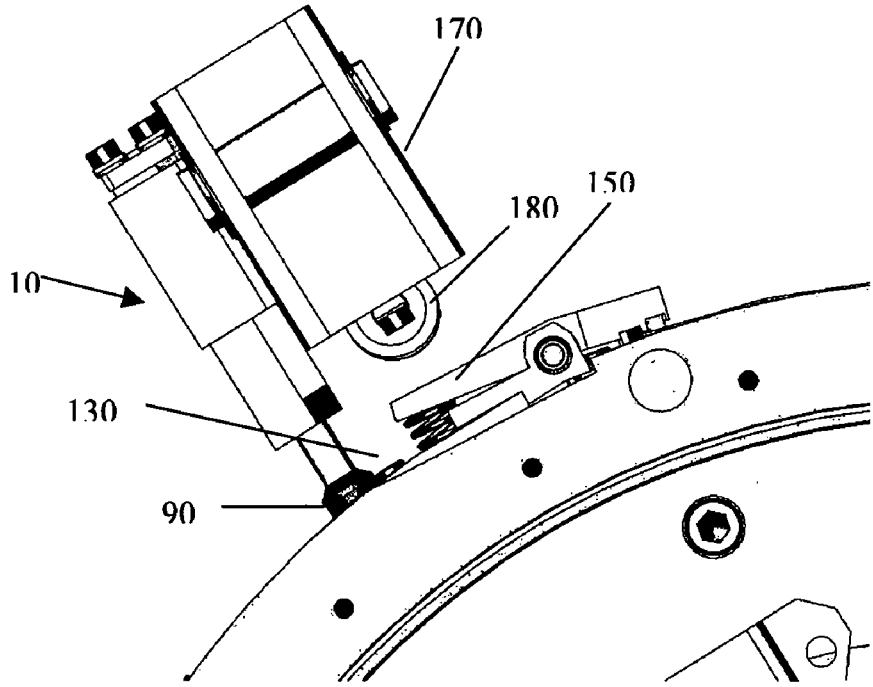

FIGS. 6A and 6B schematically show the operation of the short-circuit detector probe 10 of the present invention, mounted on the LEC actuator 170, in operation.

In FIG. 6A, the LEC actuator 170 has been brought to its operating position in order to open the LEC and allow a new plate to be clamped. Clamp actuator bearing 180 applies force to the rear-end 150 of the LEC, and the force applied to the spring 160 forces open the front-end 140 of the LEC. At the same time, probe 10, attached to actuator 170, attaches by magnetic force to contact probe area 130, which is electrically connected to registration pin 120, as described above. A plate (not shown) is now inserted under the open LEC, from the direction of its open front-end 140. When the plate touches two registration pins 120 it causes short-circuit, which is sensed by the probe 10 through contact probe area 130. At this stage the return spring 70 is expanded and push spring 80 is contracted and the probe pin 30 is at its uppermost position relative to the probe body 15, as shown in FIG. 1B.

Next, as can be seen in FIG. 6B, the LEC actuator 170 releases the LEC, in which the plate has been secured, to return to its inactive position. The probe 10 remains attached to the contact probe area 130, thus maintaining control over the continued contact of the plate with the registration pins. The probe 10 will remain attached until the actuator has reached the "detection distance" on its way up, as dictated by the distance between the stoppage means 85 and the stoppage step 60. The elevation of the probe 10, while the magnet 90 is secured to the probed area 130, causes the relative movement between stoppage means 85 and body 15 to contract return spring 70 and expand push spring 80. When the "detection distance" has been traversed, stoppage means 85 hits stoppage step 60 and is unable to move further, as shown in FIG. 1C. At this stage the return spring 70 is contracted and the push spring 80 is expanded. The probe pin is at its lower position. When the actuator continues its elevation, the probe pin disengages from the contact probe area 130 and is pushed up by the return spring 70 to its initial position (FIG. 5).

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description.

The invention claimed is:

1. A probe for detecting a short-circuit caused by an electrical short between a first electrically conductive element located in a probed area and a second electrically conductive element, said probe comprising:

a probe body having a housing;

an electrically conductive probe pin mounted within an internal cavity of the housing, said probe pin having a first end and a second end, said first end being adapted for coupling to a source of electrical voltage;

a releasable clamp for clamping the second end of the probe pin to the probe area, while permitting the probe pin to effect electrical contact with the first electrically conductive element; and a spring activated mechanism operatively coupled to the probe pin, for biasing the releasable clamp toward the probe area to assist attachment when the probe is primed and being adapted to allow limited displacement of the body of the probe away from the probed area while maintaining clamping of the second end of the probe pin to the probe area so as to maintain the electrical contact between the second end of the probe pin and the first electrically conductive element for a short time period on disengagement of the probe.

2. The probe according to claim 1, wherein the probe pin has a first section and a second section joined to the first section, such that opposing ends of the first section and the second section define the first end and the second end, respectively, of the probe pin, and the spring activated mechanism includes:

a push spring wound around the first section of the probe pin, for biasing the releasable clamp toward the probe area to assist attachment when the probe is primed;

a limiter device mounted in association with the probe pin and a stoppage step within the internal cavity of the body, said limiter device being adapted to move with the probe pin, the limiter device serving to allow limited displacement of the body of the probe away from the probed area while maintaining clamping of the second end of the probe pin to the probe area so as to maintain the electrical contact between the probe pin and the first electrically conductive element until the limiter device engages the stoppage step, whereupon further displacement of the body of the probe displaces the probe pin away from the probe area thereby disengaging the releasable clamp from the probe area and breaking electrical contact between the probe pin and the first electrically conductive element; and a return spring wound around the second section of the probe pin, said return spring being operable to retain said probe pin away from the probe area when the probe is inactive.

3. The short-circuit detection probe of claim 2, wherein the releasable clamp includes a magnet adapted to magnetically engage the second end of the probe pin and being adapted to effect magnetic coupling to the probe area.

4. The short-circuit detection probe of claim 3, wherein said magnet is coupled to the second end of the probe pin.

5. The short-circuit detection probe of claim 2, wherein said limiter device comprises a washer.

6. An apparatus for monitoring continued registration of a sheet of material in a device for processing said sheet, the apparatus comprising:

registration means for registering said sheet in a required position;

a sensor adapted to cause a short circuit upon sensing a registration condition; and the probe of claim 1 coupled to the sensor for maintaining electrical continuity, thereby continuously monitoring said registration condition during a predefined sequence of operations.

7. The apparatus of claim 6, wherein said sensor comprises an electrical sensor.

8. The apparatus of claim 7, wherein said sensor comprises an optical sensor.

9. An apparatus for monitoring continued registration of a sheet of material in a device for processing said sheet, the apparatus comprising:

registration means for registering said sheet in a required position;

a sensor adapted to cause a short circuit upon sensing a registration condition; and the probe of claim 3 magnetically connected to the sensor for maintaining electrical continuity, thereby continuously monitoring said registration condition during a predefined sequence of operations.

10. The apparatus of claim 9, wherein said sensor comprises an electrical sensor.

11. The apparatus of claim 10, wherein said sensor comprises an optical sensor.

12. A probe for detecting a short-circuit caused by an electrical short between a first electrically conductive element located in a probed area and a second electrically conductive element, said probe comprising:

a probe body having a housing;

a non-magnetic. electrically conductive probe pin mounted within an internal cavity of the housing, said probe pin having a first section and a second section joined to the first section, such that opposing ends of the first section and the second section define a first end and a second end, respectively, of the probe pin;

a magnet adapted to magnetically engage the second end of the probe pin and being adapted to effect magnetic coupling to the probe area, while permitting the probe pin to effect electrical contact with the first electrically conductive element;

a push spring wound around the first section of the probe pin, for biasing the magnet toward the probe area to assure attachment when the probe is primed;

a limiter device mounted in association with the probe pin and a stoppage step within the internal cavity of the body, said limiter device being adapted to move with the probe pin, the limiter device serving to allow limited displacement of the body of the probe away from the probed area while maintaining magnetic coupling between the magnet and the probe area and maintaining the electrical contact between the probe pin and the first electrically conductive element until the limiter device engages the stoppage step, whereupon further displacement of the body of the probe displaces the probe pin away from the probe area thereby disengaging the magnet from the probe area and breaking electrical contact between the probe pin and the first electrically conductive element; and a return spring wound around the second section of the probe pin, said return spring being operable to retain said probe pin away from the probe area when the probe is inactive.

13. An apparatus for monitoring continued registration of a sheet of material in a device for processing said sheet comprising:

registration means for registering said sheet in a required position;

a sensor adapted to cause a short circuit upon sensing a registration condition; and a probe magnetically connected to said sensor, far maintaining electric continuity, thereby continuously monitoring said registration condition during a predefined sequence of operations;

wherein the probe comprises:

a probe body having a housing and a cover, the housing defining an internal cavity having a profile;

a probe pin comprising an upper part and a lower part, the probe pin mounted within said internal cavity and comprising electrical connectivity and said lower part comprising a lower end connected to a magnet;

a push spring wound around the upper part of said probe pin, said push spring acting as a shock absorber when the magnet detaches from the probed area, said push spring alternatively pushing the magnet toward the probed area to assure attachment when the probe is active;

stoppage means mounted at the bottom of said push spring; and a return spring wound around the lower part of said probe pin, said return spring being operable to retain said probe pin in an upper position when inactive:

wherein the profile of said internal cavity comprises a stoppage step for accommodating said stoppage means at its lowermost position.

14. The apparatus of claim 13, wherein said sensor comprises an electrical sensor.

15. The apparatus of claim 13, wherein said sensor comprises an optical sensor.

* * * * *